United States Patent [19]

Boss

[11] Patent Number: 4,550,883

[45] Date of Patent: Nov. 5, 1985

[54] APPARATUS FOR STORING OR DISPENSING PAPER SHEETS OR THE LIKE

[75] Inventor: Heinz Boss, Strengelbach, Switzerland

[73] Assignee: Grapha - Holding AG, Hergiswil, Switzerland

[21] Appl. No.: 501,271

[22] Filed: Jun. 6, 1983

[30] Foreign Application Priority Data

Jun. 9, 1982 [CH] Switzerland ..... 3548/82

[51] Int. Cl.[4] ..... B65H 29/66; B65H 5/24; B65H 5/28

[52] U.S. Cl. ..... 242/59; 242/55; 53/118; 53/430

[58] Field of Search ..... 242/58, 59, 55, 58.3; 194/DIG. 26; 271/3, 3.1, 9; 53/118, 430

[56] References Cited

U.S. PATENT DOCUMENTS

| | | | |
|---|---|---|---|
| 912,330 | 2/1909 | Stilwell | 242/58.3 |
| 964,130 | 7/1910 | Stilwell | 242/58.3 |
| 3,360,209 | 12/1967 | DeRochi | 242/58 |
| 4,063,693 | 12/1977 | Achelpohl et al. | 53/118 X |
| 4,129,265 | 12/1978 | Baudy, Jr. | 242/56 A X |
| 4,200,245 | 4/1980 | Bugnone | 242/64 |
| 4,438,618 | 3/1984 | Honegger | 53/430 |

FOREIGN PATENT DOCUMENTS

| | | | |
|---|---|---|---|
| 54735 | 6/1982 | European Pat. Off. | 242/59 |
| 2804178 | 8/1979 | Fed. Rep. of Germany | 242/59 |

*Primary Examiner*—Leonard D. Christian
*Assistant Examiner*—Lloyd D. Doigan
*Attorney, Agent, or Firm*—Peter K. Kontler

[57] ABSTRACT

An apparatus which can store successive sheets of a stream of sheets between the convolutions of bands which are wound onto successive cores has a transporting unit defining for the sheets an elongated path, and a pair of feed screws which are disposed above and extend longitudinally of the path and serve to simultaneously support a core as well as a fully grown roll including a core, a band which is convoluted therearound and a supply of sheets which are confined between the convolutions of the band. The feed screws can be rotated to move the core and/or the roll thereon lengthwise of the path through a distance which at least matches the radius of a core plus the radius of a roll. A lever which is indexible through angles of 180 degrees is mounted below the path and carries a full reel and an expiring or empty reel for the band. The band extends from the full reel or from the expiring reel to an empty core or to a growing roll on the feed screws, and the core or the growing roll is rotated to draw the band from the respective reel. The band which is stored on a full reel is attached to an empty core before or immediately after the band which is supplied by the expiring reel is fully convoluted onto the respective core. The band which extends between a reel and a core intersects the path for the sheets so that it can receive sheets from the transporting unit while advancing from an expiring reel toward the respective core. The apparatus can be converted for evacuation of sheets from full rolls by connecting the leader of a band which is convoluted onto the core of a fully grown roll to an empty reel and by driving the empty reel so that the band is wound onto such reel and delivers stored sheets to the transporting unit.

13 Claims, 2 Drawing Figures

APPARATUS FOR STORING OR DISPENSING PAPER SHEETS OR THE LIKE

BACKGROUND OF THE INVENTION

The present invention relates to improvements in apparatus for storing or dispensing paper sheets or the like. More particularly, the invention relates to improvements in apparatus wherein the sheets of a stream of successive sheets can be temporarily stored between the convolutions of an elongated flexible band which is wound around the core of a roll or the like.

It is already known to temporarily store partially overlapping sheets of a scalloped or similar stream of paper sheets or the like between the convolutions of a flexible band which is wound onto the core of a roll, and to dispense such sheets by unwinding the band so that it exposes successive increments of the stored stream. A drawback of presently known apparatus of such character is that relatively long intervals of time elapse between the removal of a freshly filled roll and the start of delivery of next-following sheets to a band which is to be convoluted onto a fresh (empty) core. The same holds true when two or more full rolls of stored sheets must be relieved of stored sheets one after the other, i.e., the intervals between removal of the last sheet from a preceding roll and the start of removal of sheets from the next roll are too long. This can create problems when the sheets are to be delivered to a machine which consumes or processes large quantities of sheets per unit of time and must receive a practically uninterrupted stream of sheets. Thus, the machine which supplies sheets to, or a machine which receives sheets from, such apparatus must be arrested whenever a filled roll is to be replaced with a fresh core or whenever an expired roll is to be replaced with a fresh roll which is highly undesirable, especially when the machine forms part of a production line. Alternativey, it is necessary to provide complex and bulky intermediate reservoirs or analogous facilities which can supply sheets to a consuming machine during the intervals between the removal of sheets from successive rolls or which can receive sheets from a producing machine (e.g., a press) during the interval between the removal of a freshly filled roll and the placing of an empty core to requisite position for reception of sheets.

OBJECTS AND SUMMARY OF THE INVENTION

An object of the invention is to provide an apparatus which can store partly overlapping or non-overlapping sheets between the convolutions of bands on successive cores practically without any interruptions of the delivery of sheets subsequent to the making of a fully grown roll consisting of a core, a band which is convoluted on the core, and a supply of sheets which are confined between the convolutions of the band.

Another object of the invention is to provide an apparatus which can evacuate sheets from successive rolls practically without any interruptions between the evacuation of sheets from a preceding roll and the start of evacuation of sheets from the next-following roll.

A further object of the invention is to provide an apparatus which exhibits the above outlined advantages and can be used for storage of sheets between the convolutions of bands which are wound onto successive cores or for evacuation of sheets from successive rolls.

An additional object of the invention is to provide an apparatus which is constructed and assembled in such a way that an empty roll (i.e., a core) or an intact (fully grown) roll can be held therein in a position of readiness while a roll is in the process of growing or while a roll is in the process of paying out the convolutions of the band and the sheets which are confined between the convolutions.

Another object of the invention is to provide an apparatus which can maintain a full source of supply of band in a position of readiness while a second source of supply of band is in the process of paying out its contents for winding onto the core of a growing roll, or which can maintain an empty source of supply of band in a position of readiness to receive the band from a fully grown roll while a second source is in the process of receiving the band from a roll which is in the process of being relieved of the band and of stored sheets.

Still another object of the invention is to provide an apparatus which can be rapidly set up to deliver sheets to successive growing rolls or to evacuate sheets from successive fully grown rolls.

A further object of the invention is to provide a method of converting an apparatus from operation which involves storage of sheets between the convolutions of bands which are wound onto rotary cores to form therewith growing rolls to operation which involves evacuation of sheets from successive rolls.

Another object of the invention is to provide the apparatus with novel and improved means for carrying cores, growing rolls and/or fully grown rolls, and with novel and improved means for supporting full reels of convoluted band, partially spent reels and/or exhausted reels.

An additional object of the invention is to provide an apparatus of the above outlined character with novel and improved sheet transporting means which can receive sheets from or deliver sheets to cores of expiring or growing rolls.

The invention resides in the provision of an apparatus which can be utilized for two purposes, namely (a) to store the sheets of a stream of successive partially overlapping or non-overlapping sheets between the convolutions of bands which are paid out by reels and are wound onto rotary cores to form therewith rolls for temporary storage of sheets between the convolutions, and (b) for evacuating sheets from such rolls. The apparatus comprises a transporting unit defining for the sheets an elongated path (preferably a substantially horizontal path wherein the sheets can be moved in a first direction as well as counter to such first direction), carrier means (e.g., including two elongated rotary feed screws) for movably mounting the cores of incipient, partly grown or fully grown rolls at a level above the path (such carrier means extends in the longitudinal direction of the path and is constructed and arranged in such a way that it can simultaneously support a core and a fully grown roll), and support means (e.g., a two-armed lever which is indexible about a horizontal axis) for rotatably mounting reels at a level below the path so that a band which extends between a core on the carrier means and a reel on the support means intersects the path and can either deliver sheets to or receive sheets from the transporting unit. The support means is preferably designed to move a reel thereon between first and second positions which are spaced apart from one another, as considered in the longitudinal direction of the path. Means are provided for releasably securing the end portions of the bands to the cores and reels; such securing means can comprise hook-shaped coupling elements on the end portions of the bands and complementary recesses in the peripheral surfaces of the cores and reels or the components of Velcro (trademark) connections.

The carrier means includes means (e.g., the aforementioned feed screws) for moving cores in the longitudinal direction of the path through a distance which at least matches the radius of a fully grown roll plus the radius of a core. This renders it possible to place an empty core onto the carrier means before a freshly grown roll is removed or to place a fully grown roll onto the carrier means before an exhausted or nearly exhausted roll is removed from the carrier means. The transporting unit preferably includes means for maintaining a portion of the path in a position in which such portion of the path is at least substantially tangential to a core or to a roll on the carrier means irrespective of the position of the core or roll with reference to the carrier means, as considered in the longitudinal direction of the path. The carrier means preferably further comprises bearings for the cores and the feed screws are arranged to move the cores lengthwise of the path through the medium of the respective bearings. In such apparatus, the bearings are preferably provided with internal threads to constitute portions of or entire nuts meshing with the feed screws of the carrier means.

The apparatus further comprises means for rotating the reels which are detachably mounted on the support means or the cores which are supported by the carrier means, depending upon whether the reels must be rotated to draw the bands off the cores or vice versa. Still further, the apparatus preferably comprises means for indexing the support means through angles of predetermined magnitude, e.g., through angles of 180 degrees if the support means is designed in such a way that it can simultaneously support two reels, e.g., an intact reel (with a full supply of band convoluted thereon) and a spent or nearly spent reel.

The transporting unit can be assembled of several neighboring sections (each of which can comprise a pair of spaced apart endless belts or chains between which a band can pass between a reel on the support means and a core on the carrier means), and such transporting unit preferably further comprises a fluid-operated motor or other suitable means for moving at least one of the sections into and from register with a neighboring section, e.g., for pivoting such one section about a fixed axis. This renders it possible to prepare the apparatus for evacuation of sheets from a fully grown roll while the apparatus is still in the process of evacuating sheets from a partly or nearly spent roll. A single motor (or other suitable common prime mover means) can be provided to actuate (e.g., rotate) the moving means of the carrier means in order to advance cores in the longitudinal direction of the path, to index the support means, as well as to rotate a reel on the support means.

The novel features which are considered as characteristic of the invention are set forth in particular in the appended claims. The improved apparatus itself, however, both as to its construction and its mode of operation, together with additional features and advantages thereof, will be best understood upon perusal of the following detailed decription of certain specific embodiments with reference to the accompanying drawing.

DESCRIPTION OF THE PREFERRED EMBODIMENTS

Figures 1, 2:
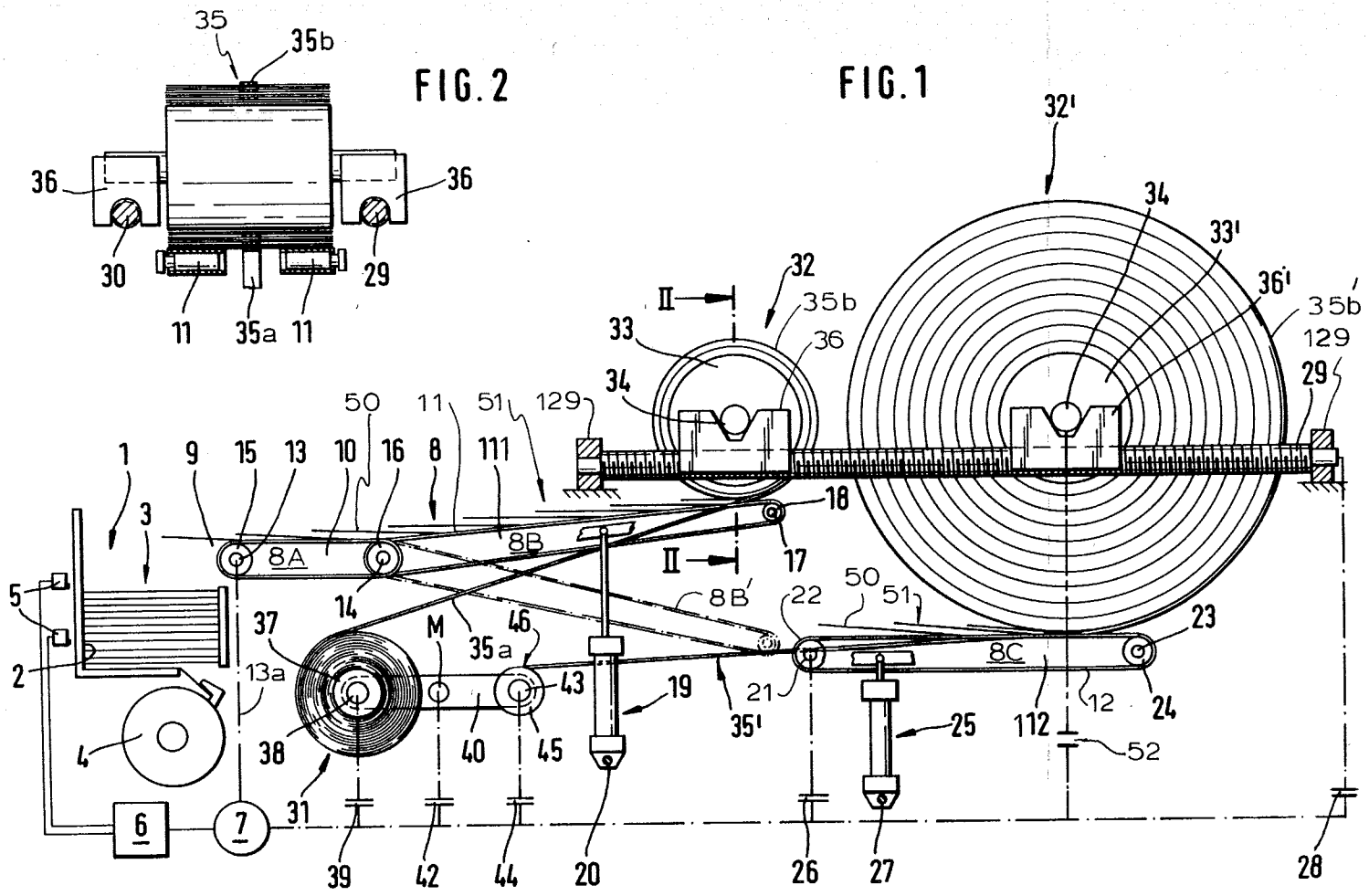
FIG. 1 is a somewhat schematic partly elevational and partly sectional view of an apparatus which embodies one form of the invention.
FIG. 2 is a fragmentary transverse vertical sectional view as seen in the direction of arrows from the line II—II of FIG. 1.

The drawing shows an apparatus which can be used for evacuation of stored sheets 50 or the like from successive rolls 32, 32' or for storing successive sheets 50 on or in the form of such rolls. The construction of the apparatus will be described with reference to its use as a means for evacuating or removing the sheets 50 from successive rolls 32, 32' and for delivering the removed sheets into the magazine 2 of a gathering machine. The magazine 2 forms part of a feeder or feeding embodiment 1 for or in the gathering machine and contains a stack 3 of superimposed sheets 50. Successive lowermost sheets 50 of the stack 3 in the magazine 2 are removed by a transfer device 4 which may be of the type disclosed in commonly owned U.S. Pat. No. 4,085,927 granted Apr. 25, 1978 to Hans Müller. The disclosure of this patent is incorporated herein by reference.

The height of the stack 3 in the magazine 2 is monitored by two level detectors 5 which are connected in circuit with a switch 6 and an electric motor 7 or another suitable prime mover. The upper level detector 5 transmits to the switch 6 a signal when the height of the stack 3 reaches a maximum permissible value whereby the switch 6 arrests the motor 7 to thus interrupt the admission of sheets 50 into the magazine 2. The lower level detector 5 transmits to the switch 6 a signal when the supply of sheets 50 in the magazine 2 is depleted sufficiently to warrant a restarting of the motor 7 via switch 6, i.e., when the admission of sheets 50 into the magazine 2 is to be resumed.

The open top of the magazine 3 is adjacent to and is located at a level below the discharge end 9 of a composite transporting unit 8 having three sections 8A, 8B and 8C. The discharge end 9 constitutes the left-hand end of the section 8A. The purpose of the transporting unit 8 is to deliver to the magazine 2 a scalloped stream 51 of partially overlapping sheets 50 when the motor 7 is on subsequent to transmission of a signal from the lower level detector 5 to the switch 6. The construction of the transporting unit 8 is such that its sections 8A, 8B, 8C can establish an elongated path for the transport of a stream 51 of sheets 50 from the roll 32' or a shorter path for the transport of a stream 51 of sheets 50 from the roll 32. In the first instance, the section 8C receives sheets 50 from the roll 32', and such sheets are transferred onto the section 8B (while the latter assumes the phantom-line position 8B') and thence to the section 8A for admission into the magazine 2. When the sheets 50 are to be accepted from the left-hand roll 32, the section 8B is held in or close to the solid-line position of FIG. 2 and delivers successive increments of the respective stream 51 to the section 8A for admission into the magazine 2.

Each of the sections 8A, 8B, 8C preferably comprises two endless belt or chain conveyors 10, 11, 12 whose upper reaches are designed to transport sheets 50 toward the open top of the magazine 2. The conveyors 10 of the section 8A are trained over parallel horizontal sprocket wheels or pulleys 15, 16 which are respectively mounted on shafts 13, 14 (e.g., pairs of stub shafts which are journalled in the respective stationary upright sidewalls or cheeks (not shown) of the apparatus.

The shaft 14 further pivotably supports two elongated levers 111 which form part of the intermediate section 8B and whose free end portions carry a horizontal shaft 17 which is parallel to the shafts 13, 14 and carries a sprocket wheel or pulley 18 (or two discrete pulleys) for the endless belt or chain conveyors 11 of the section 8B. Such conveyors are further trained over pulleys or sprocket wheels (not shown in FIG. 1 because located behind the illustrated sprocket wheel or pulley 16) on the shaft 14. It is assumed, for the sake of simplicity, that the conveyors 10, 11 and 12 are smooth-surfaced or toothed belts and that the parts 15, 16 and 18 are smooth-surfaced or toothed pulleys.

The motor 7 can drive the shaft 13 of the section 8A through the medium of an operative connection which is denoted schematically by a heavy phantom line 13*a*. The shaft 13 then drives the belts 10 which, in turn, drive the pulleys 16 and hence the belts 11.

The levers 111 of the second or median section 8B are articulately connected to the piston rod of a double-acting fluid-operated motor 19 (e.g., a pneumatic cylinder and piston unit) whose cylinder is pivotable on a pin or shaft 20 secured to one of the aforementioned sidewalls. The purpose of the motor 19 is to pivot the section 8B between the solid-line position and the phantom-line position 8B'. As mentioned above, when in phantom line position 8B', the section 8B enables its belts 11 to accept a stream 51 of partially overlapping sheets 50 from the upper reaches of the belts 12 forming part of the third section 8C.

The section 8C further comprises a horizontal shaft 21 which is fixedly mounted in the sidewalls of the frame and carries pulleys 22 for the respective end turns of the belts 12. The shaft 21 further supports two elongated pivotable levers 112 whose free end portions are connected to one another by a horizontal shaft 23 for pulleys 24. The belts 12 are trained over the pulleys 22 and 24. A second fluid-operated motor 25 (e.g., a double-acting pneumatic cylinder and piston unit) is provided to pivot the levers 112 about the axis of the shaft 21 between a preferably infinite number of positions so that the upper reaches of the belts 12 can receive a stream 51 of partly overlapping sheets 50 from the roll 32'. The shaft 21 can receive torque from the output element of the motor 7 through the medium of a transmission including a clutch 26. The reference character 27 denotes a fulcrum for the cylinder of the motor 25 whose piston rod is attached to one of the levers 112. The stroke of the motor 25 preferably suffices to ensure that the pulleys 24 can be lifted to a level close to the lowermost portion of the core 33' of the roll 32'.

The carrier means for releasably supporting and shifting the rolls 32 and 32' sideways comprises two parallel horizontal feed screws 29, 30 which are installed at a level above the transporting unit 8. The end portions of the feed screws 29 and 30 are rotatable in bearing members which are mounted in or on or form part of the aforementioned frame. FIG. 1 merely shows the bearing members 129 for the end portions of the feed screw 29. The feed screws 29 and 30 can receive torque from the motor 7 through the medium of a clutch 28.

The left-hand roll 32 of FIG. 1 has a core 33 whose shaft 34 is mounted in bearings 36 (see also FIG. 2) each of which constitutes one-half of an internally threaded nut or follower resting on the respective one of the feed screws 29, 30 so that, when the feed screws are rotated by the motor 7 via clutch 28, the bearings 36 advance the roll 32 toward or away from the magazine 2 of the feeder 1, depending upon the direction of rotation of the feed screws. The core 33 is connected with the trailing end of an elongated narrow elastic band 35 whose leader is connected to the hub 37 of a takeup reel 31. The sheets 50 of the left-hand stream 51 of FIG. 1 are stored and held between the neighboring convolutions 35*b* of the band 35 on the core 33 of the roll 32. The stream 51 is shown as consisting of partially overlapping sheets 50; however, the apparatus of the present invention is equally suited for storage and delivery to the magazine 2 of sheets which are disposed end-to-end, i.e., which need not necessarily overlap each other and which may but need not be immediately or closely adjacent to one another. As can be seen by looking at FIG. 1, the supply of sheets 50 on the core 33 of the roll 32 is nearly exhausted, i.e., the major part of the band 35 is already convoluted on the hub 37 of the reel 31. The hub 37 is non-rotatably but preferably detachably mounted on a shaft 38 which is mounted on one arm of a two-armed lever 40 constituting a support for the reel 31 as well as for a similar reel 46. For example, the shaft 38 can have external splines mating with internal splines of the hub 37 so that the latter can be slipped off the shaft 38, when necessary, to transfer the fully loaded reel 31 into an apparatus where the band 35 is to be convoluted onto an empty roll to store thereon a substantial supply of paper sheets 50 or the like. Reference may be had to commonly owned copending patent application Ser. No. 501,018 filed June 6, 1983 by Heinz Boss for "Apparatus for temporary storage of paper sheets". Alternatively, the connection between the shaft 38 and the hub 37 can constitute or comprise a single key-and-groove arrangement. The shaft 38 can receive torque from the motor 7 through the medium of a clutch 39.

The lever 40 is non-rotatably connected to a horizontal shaft M which is journalled in the sidewalls of the frame and can be coupled to the output element of the motor 7 through the medium of a clutch 42 so as to turn through angles of 180 degrees, i.e., to cause the reels 31 and 46 to switch positions. The second takeup reel 46 has a hub 45 which is connected to the leader of a second elongated elastic flexible band 35' and is connected for rotation with a shaft 43 on the respective arm of the lever 40. A clutch 44 is provided to rotate the shaft 43 in a direction to convolute the band 35' on the hub 45 of the reel 46. The separable torque transmitting connection between the shaft 43 and hub 45 is preferably identical with that between the shaft 38 and hub 37.

The trailing end of the band 35' is separably attached to the core 33' of the roll 32'. This core has a shaft 34 whose end portions are removably received in suitable notches of two bearings 36'. The bearings 36' are identical with or similar to the aforementioned bearings 36 and their half-nut like lower portions are in mesh with the respective feed screws 29, 30. The means for separably attaching the end portions of bands 35, 35' to the respective reels can include hook-shaped coupling elements on the end portions of the bands and complementary recesses in the peripheral surfaces of the reels, or the components of Velcro (trademark) connections. Analogous or identical attaching means can be used to releasably secure the end portions of bands 35, 35' to the respective cores.

The operation of the apparatus is as follows:

The motor 7 is on because the level of the topmost sheet 50 in the stack 3 is somewhere between the levels of the two detectors 5, and the clutch 39 is engaged so that the motor 7 drives the shaft 38 in a counterclockwise direction, as viewed in FIG. 1, to wind the band 35 onto the hub 37 of the left-hand takeup reel 31. The roll 32 moves gradually toward the left-hand end portions of the feed screws 29, 30 which rotate because the clutch 28 is engaged. The speed of the feed screws 29, 30 is synchronized with the RPM of the shaft 38 so that the bearings 36 gradually advance toward the feeder 1 at a rate which can be exactly or substantially proportional to the rate at which the diameter of the roll 32 decreases. The motor 19 maintains its piston rod in the extended position so that the upper reaches of the belts 11 in the median section 8B of the transporting unit 8 are in optimum positions to receive successive sheets 50 of the left-hand stream 51 from the upper side of the running band 35. As can be seen in FIG. 2, the band 35 is disposed in a vertical plane which is located between the two belts 11 of the median section 8B. This ensures smooth and predictable transfer of sheets 50 from the upper side of the band 35 onto the upper sides of upper reaches of the belts 11 which transport the sheets 50 of the respective scalloped stream 51 toward and onto the belts 10 of the first section 8A for admission into the magazine 2. FIG. 1 shows that the path which is defined by the downwardly sloping portion **35*a* of the band 35 between the outermost band convolution 35*b* on the core 33 of the roll 32 and the outermost band convolution on the reel 31 intersects the path which is defined by the sections 8A and 8B of the transporting unit 8. The upper reaches of the belts 11 are substantially tangential to the outermost convolution 35*b* of the band 35 on the core 33 of the roll 32, and the lower chamber of the motor 19 contains a body of fluid whose pressure suffices to ensure that the angular positions of the levers 111 change (in a counterclockwise direction, as viewed in FIG. 1) at the rate at which the diameter of the roll 32 decreases, i.e., the upper reaches of the belts 11 remain tangential to the outermost convolution 35*b* of the band 35 on the roll 32 irrespective of the diameter of this roll. The aforementioned paths (defined by the band portion 35*a* and by the upper reaches of the belts 11) intersect or meet at the locus or close to the locus where the band portion 35*a* merges into the outermost convolution 35*b* on the core 33**.

The motor 7 drives the shaft 13 in a counterclockwise direction, as viewed in FIG. 1, so that the upper reaches of the belts 11 and 10 advance toward the open top of the magazine 2 and the latter receives successive sheets 50 of the stream 51 which is being paid out by the roll 32.

The full-sized (intact) roll 32' is introduced into the apparatus (i.e., the bearings 36' are placed onto the feed screws 29, 30) shortly before the supply of sheets 50 which are stored on the roll 32 is exhausted. Such placing of bearings 36' onto the feed screws 29, 30 is followed by attachment of the leader of the band 35' to the hub 45 of the empty reel 46, either while the hub 45 is already mounted on the shaft 43 of the lever 40 or prior to such mounting. For example, the leader of the band 35' can be provided with one-half of a commercially available Velcro (trademark) connection the other half of which is provided on the hub 45. The motor 25 is actuated to move the upper reaches of the belts 12 to the illustrated positions, i.e., the upper reaches of these belts are substantially tangential to the outermost convolution **35*b'* of the band 35' on the roll 32'**.

When the band 35 is completely detached from the core 33 of the roll 32 (such detachment can be facilitated by providing the trailing end of the band 35 and the core 33 with the components of a Velcro (trademark) connection), a suitable sensor or another monitoring device (or the attendant) detects the advancement of the last sheet 50 of the left-hand stream 51 beyond the check point (adjacent to the upper reaches of the belts 11 or 10) and causes the motor 19 to lower the levers 111 so that the median section 8B of the transporting unit 8 assumes the phantom-line position 8B' in which the upper reaches of the belts 11 can receive sheets 50 of the right-hand stream 51 from the belts 12 of the section 8C. The clutches 26 and 44 are engaged at the same time so that the motor 7 drives the shaft 43 in a counterclockwise direction (as viewed in FIG. 1) and draws the band 35' off the roll 32' while the shaft 21 drives the belts 12 so that their upper reaches deliver sheets 50 onto the upper reaches of the belts 11 whence the sheets advance toward and into the magazine 2 by way of the section 8A. Thus, the magazine 2 continues to receive sheets 50 practically without interruption, first from the roll 32 and immediately or shortly thereafter from the roll 32'.

Once the magazine 2 receives sheets 50 from the roll 32' (via sections 8C, 8B and 8A of the transporting unit 8), the attendant removes the full reel 31 from the shaft 38 and puts the reel 31 into storage or delivers or causes the delivery of such reel to the station where the band 35 is convoluted onto an empty core (e.g., 32) to store thereon a fresh supply of sheets 50 or the like. The core 33 of the empty roll 32 is also removed, together with the bearings 36, for delivery into the aforementioned apparatus where the core is connected with the leader (later the trailing end) of a band (such as the band 35) to gather a fresh supply of sheets 50 or the like.

The motor 7 drives the feed screws 29 and 30 via clutch 28 while the roll 32' pays out the band 35' and the respective stream 51 of sheets 50 so that the bearings 36' gradually advance toward the feeder 1 while the diameter of the roll 32' decreases. The clutch 42 is engaged to turn the lever 40 through approximately 180 degrees as soon as the roll 32' reaches a position substantially midway between the end portions of the feed screws 29 and 30. This causes the shafts 38 and 43 to switch positions, i.e., the reel 46 (whose diameter is on the increase because it gathers successive increments of the band 35') assumes the position which, in FIG. 1, is occupied by the reel 31 and the shaft 38 is free to receive an empty reel which is held in a position of readiness for attachment to a further band, not shown. Thus, the growing reel 46 is transferred closer to the feeder 1 and the shaft (38) which does not carry a reel is moved closer to the section 8C of the transporting unit 8, i.e., nearer to the location of the next full roll when such roll is placed onto the feed screws 29 and 30.

The clutch 26 can be disengaged and the motor 25 can be caused to move the section 8C to the illustrated position, or to a level below such illustrated position, as soon as the advancing roll 32' moves sufficiently close to the feeder 1 so that its belt 35' delivers successive sheets 50 directly onto the upper reaches of the belts 11 in the median section 8B, i.e., as soon as the belts 12 cease to participate in the delivery of sheets 50 from the band 35' to the belts 11. The bearings of a fresh roll can be placed onto the right-hand portions of the feed screws 29, 30 as soon as the roll 32' advances sufficiently close to the feeder 1 and its magazine 2 to provide room for insertion of a large-diameter (fresh) roll. The leader of the band which is convoluted onto such fresh roll is then attached to the hub of an empty reel which is placed onto the shaft 38 of the lever 40, and the apparatus is ready to proceed with removal of sheets from such fresh roll as soon as the supply of sheets which are stored on the core 33' of the roll 32' is exhausted. The length of each of the feed screws 29, 30 is preferably selected in such a way that they can simultaneously support the bearings of a fresh roll (such as 32') and the bearings for the core (such as 33) of an empty or nearly exhausted roll so that the fresh roll does not interfere with rotation of the nearly exhausted roll and that the nearly exhausted roll does not interfere with the placing of the bearings of the fresh roll onto the right-hand portions of the feed screws. In other words, the length of each of the feed screws 29, 30 should at least equal but should preferably at least slightly exceed the radius of a fresh roll plus the radius of a core 33 or 33'.

The apparatus of the present invention can be used with equal or similar advantage for the storage of sheets 50 or the like on the cores of rolls. For example, the motor 7 can be of the reversible type so that it can drive the shaft 13 clockwise or counterclockwise. Also, the apparatus then comprises suitable torque transmitting connections between the reversible motor 7 (or a motor which replaces the motor 7) and the cores 33 and 33' because such cores must be driven in lieu of the shafts 38 and 43. FIG. 1 shows an operative connection including a clutch 52 which can be engaged to transmit torque from the motor 7 to the shaft 34 of the core 33'. A similar connection can be provided to drive the core 33. A conveyor (not shown but disclosed in the aforementioned copending application Ser. No. 501,018 of Heinz Boss) is provided to deliver a scalloped stream or a stream of non-overlapping sheets onto the upper reaches of the belts 10 in the section 8A of the transporting unit 8. The roll 32 is first to receive the sheets while the motor drives the feed screws 29, 30 in a direction to move the bearings 36 for the roll 32 in a direction to the right, i.e., away from the location where successive sheets of the stream are supplied to the section 8A. When the diameter of the growing roll 32 reaches a certain value, the lever 40 is indexed through 180 degrees to move the expiring reel 31 further to the right, as viewed in FIG. 1. The growing roll 32 pivots the levers 111 of the median section 8B in a clockwise direction and the clutch 26 is engaged not later than when the running band 35 moves its portion **35*a* beyond the right-hand ends of the belts 11, i.e., when it becomes necessary to resort to the section 8C in order to ensure delivery of oncoming sheets onto the upper side of the band portion 35*a* (at such time, the band portion 35*a* advances from the reel 31 toward the core 33 of the growing roll 32). When the band 35 is fully wound onto the core 33 of the roll 32, the bearings 36 are close to the right-hand end portions of the feed screws 29, 30 and the fully grown roll 32** can be lifted off the feed screws for transfer into an apparatus which serves to deliver sheets from the roll into a magazine or the like, or into storage.

Shortly before the roll 32 reaches its maximum diameter, the operator places the bearings (e.g., 36') of an empty roll onto the feed screws 29, 30 close to the left-hand end portions of such feed screws. A full reel is attached to the shaft 43 (which is then held in the position occupied in FIG. 1 by the shaft 38) and the leader of the band on such full reel is attached to the core of the empty roll on the feed screws 29 and 30 as soon as the roll 32 has fully grown and there develops a gap between the stream portion which is stored on the roll and the leader of the next stream portion. The presence of such gap can be detected by the operator or by a suitable monitoring device. The conveyor which delivers sheets to the section 8A can be arrested in response to a signal from a suitable device (not shown) which monitors the diameter of the growing roll 32 or in response to a signal from a device which monitors the position of the roll 32 with reference to the feed screws 29, 30.

The exact nature of the monitoring means which are used in the improved apparatus to automate the operation to a desired extent forms no part of the present invention. Such monitoring means can be used irrespective of whether the apparatus is used to deliver sheets from rolls to a magazine or the like, or whether the apparatus is used to store sheets on successive rolls.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for storing the sheets of a stream of successive sheets between the convolutions of bands which are paid out by reels and are wound onto rotary cores to form therewith rolls for temporary storage of sheets and for evacuating stored sheets from such rolls, comprising a transporting unit defining for the sheets an elongated path; carrier means for movably mounting the cores of rolls at a level above said path, said carrier means extending in the longitudinal direction of said path and being arranged to simultaneously support a core and a roll; and support means for for movement in said direction wherein said transporting unit includes means for maintaining a portion of said path in a position in which such portion is at least substantially tangential to a core for winding and to a roll for unwinding on said carrier means irrespective of the position of the core for winding and the roll for unwinding with reference to the carrier means rotatably mounting a plurality of reels at a level below said path so that a band which extends between a core on said carrier means and a reel on said support means intersects said path.

2. The apparatus of claim 1, further comprising bearings for the cores in said carrier means.

3. The apparatus of claim 1, wherein said support means includes means for moving a reel thereon between first and second positions which are spaced apart from one another as considered in the longitudinal direction of said path.

4. The apparatus of claim 1, further comprising means for releasably securing the ends of bands to the cores and reels.

5. The apparatus of claim 1, wherein said carrier means includes means for moving cores in the longitudinal direction of said path through a distance which at least matches the radius of a roll plus the radius of a core.

6. The apparatus of claim 5, further comprising bearings for the cores on said carrier means, said moving means being arranged to move the cores in the longitudinal direction of said path through the medium of said bearings.

7. The apparatus of claim 6, wherein said bearings have internal threads and said moving means comprises parallel feed screws meshing with said bearings and means for rotating said feed screws.

8. The apparatus of claim 1, further comprising means for rotating the reels on said support means.

9. The apparatus of claim 1, further comprising means for indexing said support means through angles of 180 degrees, said support means including means for simultaneously carrying a full reel as well as a spent reel.

10. The apparatus of claim 1, wherein said transporting unit comprises a series of neighboring sections and means for moving at least one of said sections into and from register with a neighboring section.

11. The apparatus of claim 10, wherein said moving means comprises means for pivoting said one section about a fixed axis.

12. The apparatus of claim 1, wherein said carrier means comprises means for moving cores in the longitudinal direction of said path and further comprising means for rotating the reels on said support means and common prime mover means for said moving means and said rotating means.

13. The apparatus of claim 1, wherein the dimensions of said support means are selected in such a way that the support means can simultaneously carry several reels.

* * * * *